US011614702B2

(12) United States Patent
Fukue et al.

(10) Patent No.: US 11,614,702 B2
(45) Date of Patent: Mar. 28, 2023

(54) FIXING DEVICE

(71) Applicant: BROTHER KOGYO KABUSHIKI KAISHA, Nagoya (JP)

(72) Inventors: Shuhei Fukue, Aichi (JP); Tatsuo Ogasawara, Aichi (JP); Tokifumi Tanaka, Aichi (JP); Tomonori Watanabe, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/387,215

(22) Filed: Jul. 28, 2021

(65) Prior Publication Data

US 2022/0035283 A1 Feb. 3, 2022

(30) Foreign Application Priority Data

Jul. 30, 2020 (JP) ..... JP2020-128877

(51) Int. Cl.
*G03G 15/20* (2006.01)

(52) U.S. Cl.
CPC ..... *G03G 15/2028* (2013.01)

(58) Field of Classification Search
CPC ..... G03G 15/2028; G03G 15/757
See application file for complete search history.

(56) References Cited

FOREIGN PATENT DOCUMENTS

| | | | | |
|---|---|---|---|---|
| JP | 2001034093 A | * | 2/2001 | |
| JP | 2004109583 A | | 4/2004 | |
| JP | 2007178756 A | | 7/2007 | |
| JP | 2010204485 A | | 9/2010 | |
| JP | 2014191133 A | | 10/2014 | |
| JP | 2017105605 A | * | 6/2017 | ..... G03G 15/234 |
| JP | 2018017814 A | * | 2/2018 | |

OTHER PUBLICATIONS

JP_2017105605_A_T MachineTranslation, Japan, Jun. 2017, Koyama.*
JP_2001034093_A_T MachineTranslation, Japan, Feb. 2001, Ishizaki.*
JP_2018017814_A_T MachineTranslation, Japan, Feb. 2018, Sawamura.*

* cited by examiner

*Primary Examiner* — Victor Verbitsky
(74) *Attorney, Agent, or Firm* — Merchant & Gould P.C.

(57) ABSTRACT

In a fixing device, an endless belt is nipped between a roller and a nip-forming member, and a sheet is conveyed through a first nip region formed between the endless belt and the roller by the nip-forming member. A pair of conveyor rollers located downstream of the first nip region in a sheet conveyance direction are configured to convey the sheet through a second nip region formed therebetween. A sheet guide located between the roller and the pair of conveyor rollers includes a first guide which in a plane perpendicular to a rotation axis of the roller, intersects with a line tangent to an outer cylindrical surface of the roller at a downstream end of the first nip region, while an extension line of the first guide intersects with a line segment connecting the downstream end of the first nip region to an upstream end of the second nip region.

20 Claims, 6 Drawing Sheets

FIXING DEVICE

CROSS-REFERENCE TO RELATED APPLICATION(S)

This application claims priority from Japanese Patent Application No. 2020-128877 filed on Jul. 30, 2020, the disclosure of which is incorporated herein by reference in its entirety.

TECHNICAL FIELD

Apparatuses disclosed herein relate to a fixing device for thermally fixing a toner image on a sheet.

BACKGROUND ART

A known fixing device, for example, using a fuser roller (heating roller) and a pressure belt, may include a separator which contacts the fuser roller to separate a sheet from the fuser roller.

SUMMARY

Disadvantageously, the contact of the separator with the fuser roller could possibly damage the fuser roller, while without a separator a sheet would separate from the fuser roller at a position farther from the nip position and thus be made more liable to curl.

It would be desirable to provide a fixing device without a separator, in which curling of a sheet can be suppressed.

In one aspect, a fixing device is disclosed herein, which comprises a roller, an endless belt, a nip-forming member, a heater, a pair of conveyor rollers, and a sheet guide. The nip-forming member is configured to form a first nip region between the endless belt and the roller. A second nip region is formed between the pair of conveyor rollers. The pair of conveyor rollers are configured to convey the sheet through the second nip region. The sheet guide is located between the roller and the pair of conveyor rollers. The sheet guide comprises a first guide along which to guide a roller-side surface of the sheet. In a plane perpendicular to a rotation axis of the roller, the first guide intersects with a line tangent to an outer cylindrical surface of the roller at a downstream end of the first nip region. In the plane perpendicular to the rotation axis of the roller, an extension line of the first guide intersects with a line segment connecting the downstream end of the first nip region to an upstream end of the second nip region.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

Figure 1:
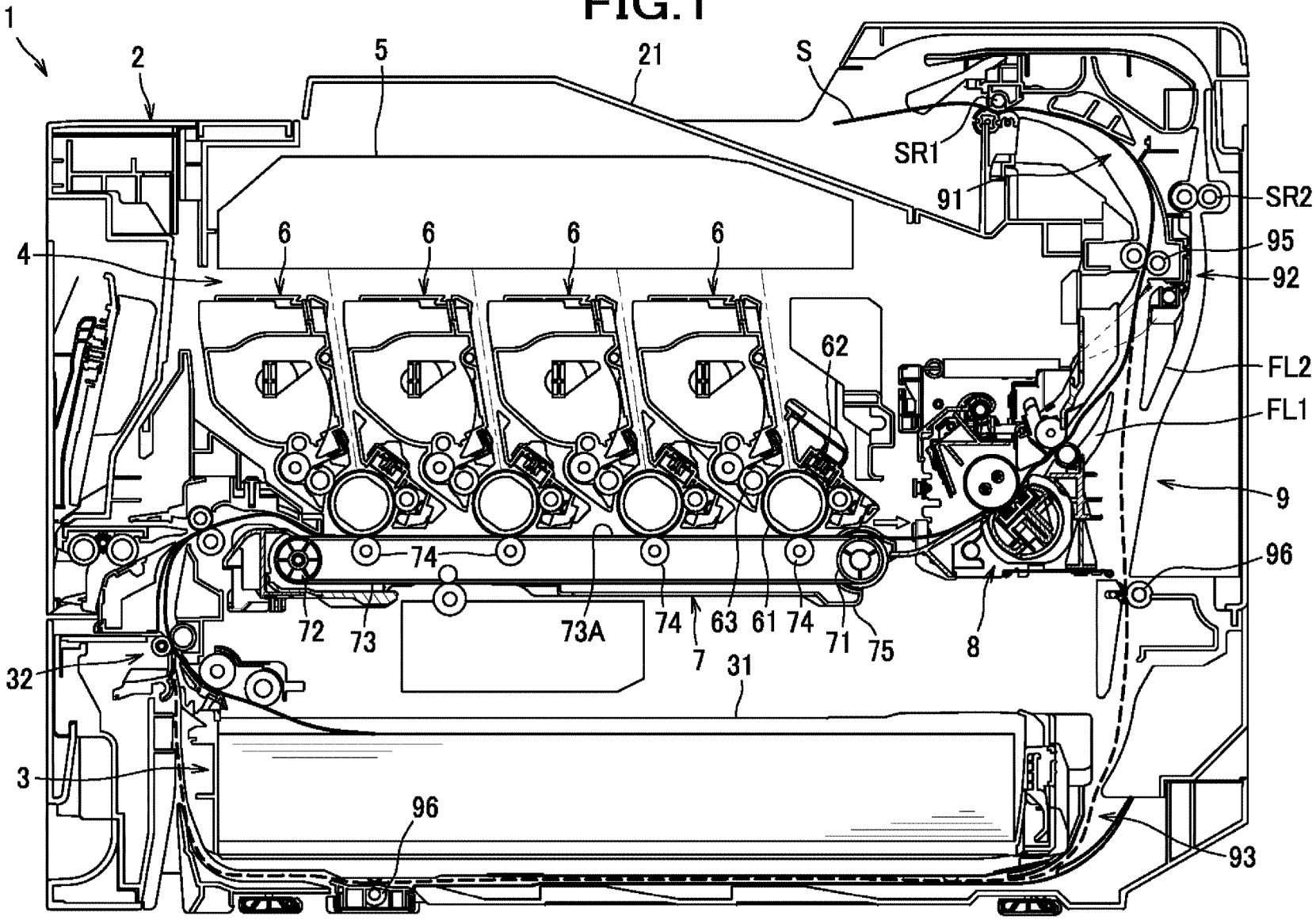
FIG. 1 is a section view of an image forming apparatus including a fixing device.

As shown in FIG. 1, an image forming apparatus 1 is configured to be able to form images on both sides of a sheet S. The image forming apparatus 1 includes a housing 2, and various components housed in the housing 2, which include a sheet feeder unit 3, an image forming unit 4, a fixing device 8, and a conveyor unit 9. The image forming apparatus 1 illustrated herein is a color printer.

The housing 2 includes an output tray 21 provided in an upper surface thereof.

The sheet feeder unit 3 is provided in a lower space inside the housing 2, and includes a sheet feed tray 31 configured as a receptacle to hold and serve sheets S, and a sheet feed mechanism 32 configured to feed a sheet S held in the sheet feed tray 31, into the image forming unit 4.

The image forming unit 4 has a function of transferring a toner image onto a sheet S to form an image on the sheet S. The image forming unit 4 includes an exposure device 5, four process cartridges 6, and a transfer unit 7.

The exposure device 5 is provided in an upper space inside the housing 2, and includes a light source, a polygon mirror and other components which are not illustrated. The exposure device 5 is configured to rapidly scan a surface of each photoconductor drum 61 with a light beam (see alternate long and short dashed lines) in accordance with image data, to thereby expose the surface of the photoconductor drum 61 to the light beam.

Each process cartridge 6 includes a photoconductor drum 61, a charger 62, and a development roller 63. Toner of a specific color of yellow, magenta, cyan or black is each stored in a corresponding process cartridge 6.

The transfer unit 7 includes a drive roller 71, a follower roller 72, a conveyor belt 73, four transfer rollers 74, and a belt frame 75. The conveyor belt 73 is an endless belt. The conveyor belt 73 conveys a sheet S with a toner image formed thereon to a guide surface 151 of a chute 150 of the fixing device 8 (see FIG. 2).

The belt frame 75 is a frame by which the drive roller 71 and the follower roller 72 are rotatably supported. The conveyor belt 73 is looped around the drive roller 71 and the follower roller 72. The upper side of the conveyor belt 73 serves as a sheet conveyance surface 73A on which a sheet S is placed and conveyed toward the fixing device 8. The transfer rollers 74 are located inside the conveyor belt 73, and so arranged that the conveyor belt 73 is held between each transfer roller 74 and the corresponding photoconductor drum 61.

The charger 62 charges the surface of the photoconductor drum 61. The exposure device 5 exposes the charged surface of the photoconductor drum 61 to light, so that an electrostatic latent image produced based on image data is formed on the surface of the photoconductor drum 61.

The development roller 63 supplies toner to the electrostatic latent image formed on the surface of the photoconductor drum 61. A toner image is thus formed on the surface of the photoconductor drum 61. When a sheet S is conveyed through between the photoconductor drum 61 and the transfer roller 74, the toner image on the surface of the photoconductor drum 61 is transferred onto the sheet S.

The fixing device 8 is a device configured to thermally fix a toner image on a sheet S. Details of the fixing device 8 will be described later.

The conveyor unit 9 is configured to convey a sheet S outputted from the fixing device 8 (via a first conveyor roller, that is, a pair of conveyor rollers 85 of the fixing device 8, which will be described below; see FIG. 2) either toward outside of the housing 2 or toward the image forming unit 4 again. The conveyor unit 9 includes a first path 91, a second path 92, a third path 93, a second conveyor roller 95, a first switchback roller SR1, a second switchback roller SR2, and a plurality of re-conveyor rollers 96, a first flapper FL1, and a second flapper FL2. The first flapper FL1 and the second flapper FL2 are configured to be swingable relative to the first path 91, the second path 92 and the third path 93.

The first path 91 is configured to guide a sheet S conveyed from the fixing device 8 toward the output tray 21. The second path 92 is configured to provide a different route through which to guide a sheet S conveyed from the fixing device 8 toward the output tray 21. The third path 93 is configured to guide a sheet S drawn in the housing 2 by the rollers (the first switchback roller SR1 and the second conveyor roller 95, or the second switchback roller SR2) which will be described later, to the sheet feed mechanism 32 provided upstream of the image forming unit 4.

The second conveyor roller 95, the first switchback roller SR1 and the second switchback roller SR2 are each configured as a roller capable of rotating in normal and reverse directions. When rotating in the normal direction, the second conveyor roller 95, the first switchback roller SR1 and the second switchback roller SR2 convey a sheet S forward toward the outside of the housing 2, i.e., toward the output tray 21. When rotating in the reverse direction, the second conveyor roller 95, the first switchback roller SR1 and the second switchback roller SR2 draws a sheet S back into the housing 2.

The second conveyor roller 95 and the first switchback roller SR1 are provided in the first path 91. The first switchback roller SR1 is located closer, than the second conveyor roller 95, to the output tray 21. The second switchback roller SR2 is provided in the second path 92.

The re-conveyor rollers 96 are provided in the third path 93, and configured to convey a sheet S in the third path 93 toward the sheet feed mechanism 32.

In the conveyor unit 9, the positions of the first flapper FL1 and the second flapper FL2 can be switched in a manner that causes a sheet S to be conveyed from the fixing device 8 selectively toward the first conveyor path 91 or toward the second conveyor path 92, and to be conveyed from the first conveyor path 91 or the second conveyor path 92 toward the third path 93.

Figure 2:
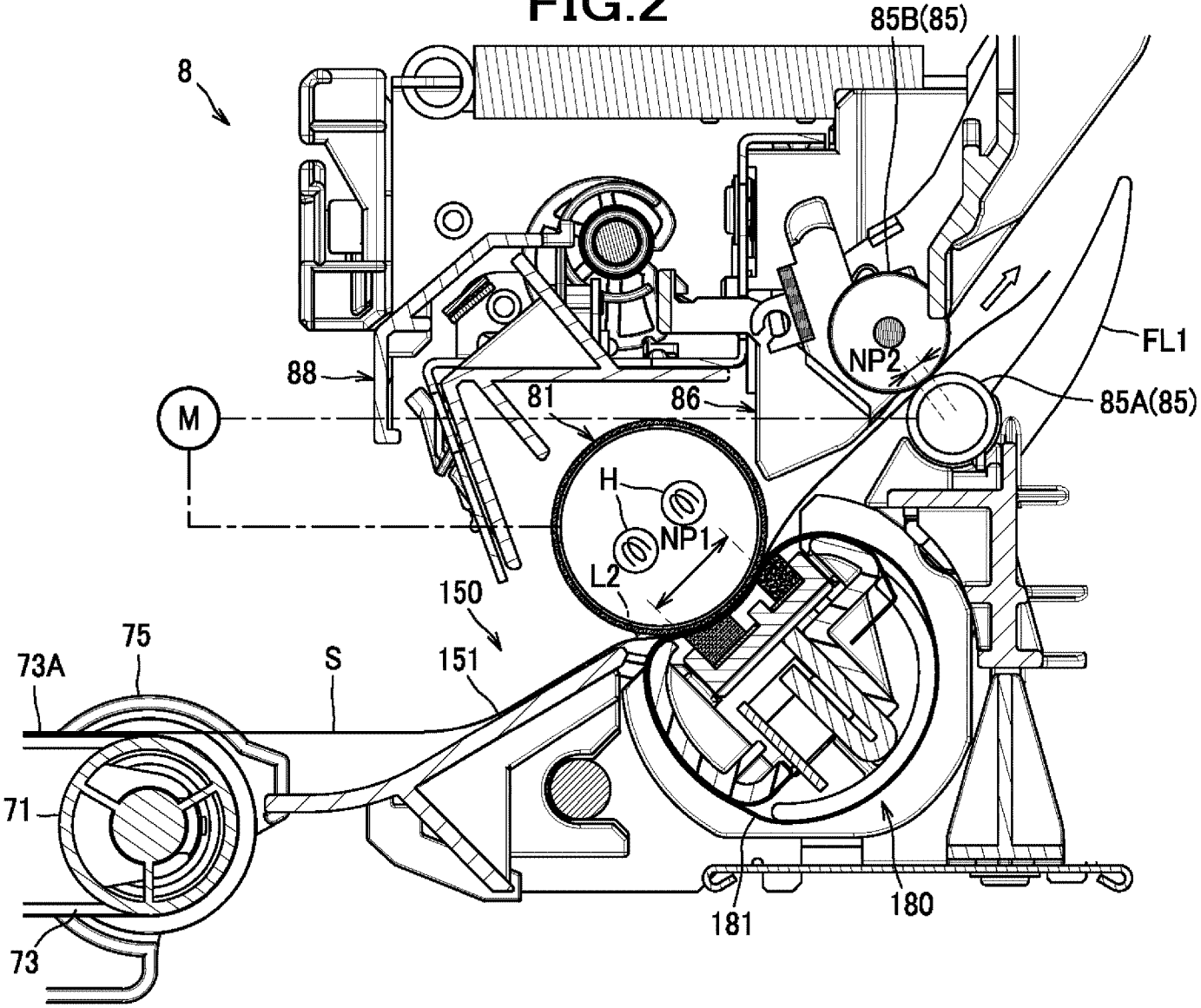
FIG. 2 is a section view of the fixing device.

As shown in FIG. 2, the fixing device 8 includes two heaters H, a roller 81, a fixing member 180, a chute 150, a fixing frame 88, a nip-pressure control mechanism 200 (see FIG. 4), a pair of conveyor rollers 85, and a sheet guide 86. The first flapper FL1 mentioned above is provided on the fixing frame 88.

Figure 3:
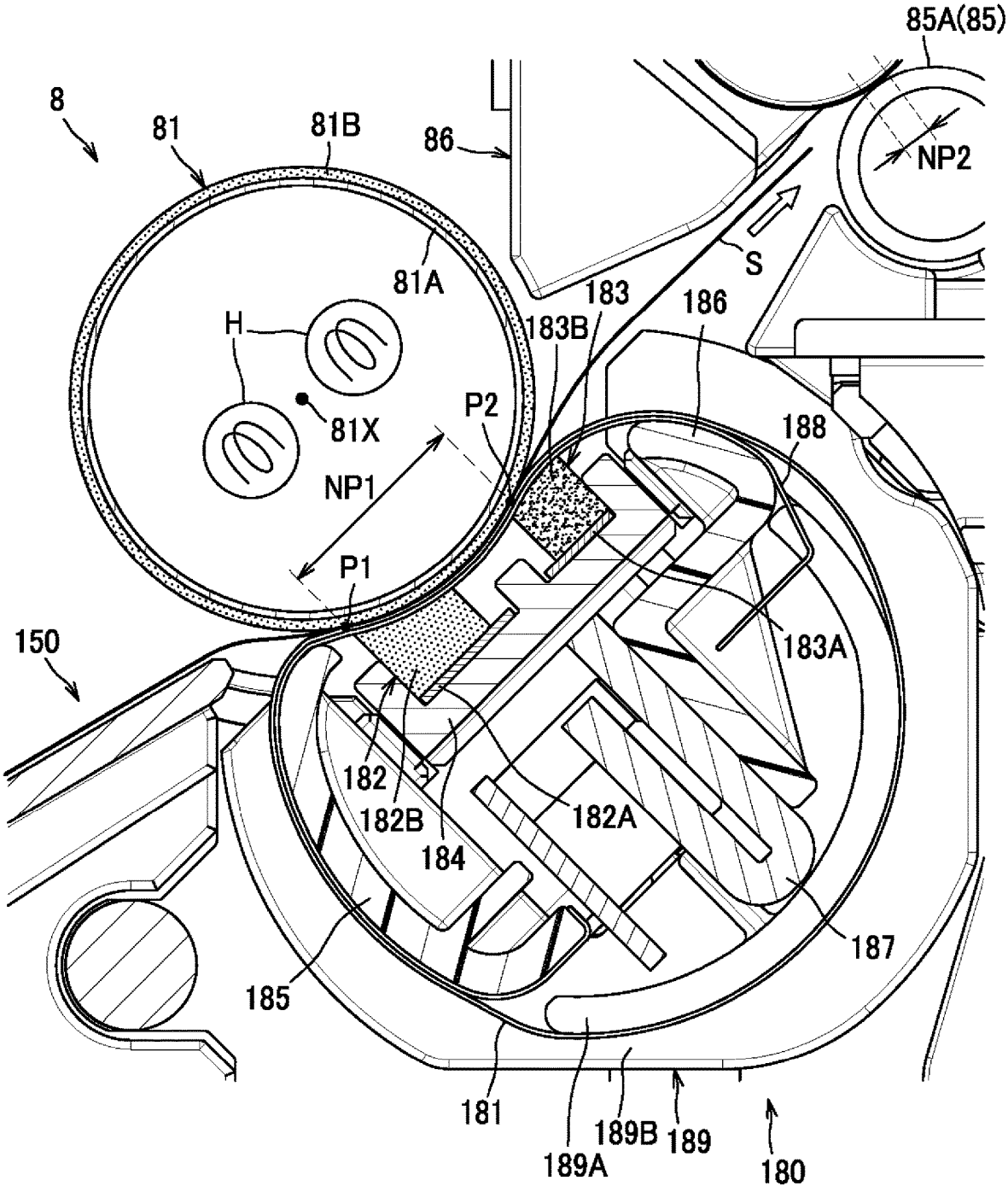
FIG. 3 is a partially enlarged section view of the fixing device, showing a heating roller, a fixing member, and their vicinities.

As shown in FIG. 3, the roller 81 includes a tube blank 81A and an elastic layer 81B. The tube blank 81A is a pipe made of metal. The roller 81 is supported rotatably about a rotation axis 81X via bearings (not shown) on the fixing frame 88. The roller 81 is driven to rotate by a motor M (see FIG. 2) provided in the image forming apparatus 1. The elastic layer 81B is provided on an outer cylindrical surface of the tube blank 81A. In other words, the roller 81 includes the elastic layer 81B by which an outer cylindrical surface of the roller 81 is provided. The elastic layer 81B has elasticity.

The two heaters H are located inside the tube blank 81A of the roller 81 to heat the roller 81. In other words, the heaters H are located inside the roller 81.

The fixing member 180 is configured to form a first nip region NP1 in combination with the roller 81. The fixing member 180 and the roller 81 nip and convey a sheet S therebetween. The fixing member 180 includes an endless belt 181, two nip-forming members 182, 183, a support member 184, an upstream belt guide 185, a downstream belt guide 186, a stay 187, a slide sheet 188, and side guides 189.

The endless belt 181 is made of heat-resistant plastic resin. The endless belt 181 has a width greater than a maximum width of a sheet S to be conveyed in the image forming apparatus 1. The endless belt 181 and the roller 81 nip and convey a sheet S therebetween.

The nip-forming members 182, 183 form the first nip region NP1 in combination with the roller 81. To be more specific, each of the nip-forming members 182, 183 and the roller 81 nip the endless belt 181 and the slide sheet 188 as well as a sheet S to be conveyed into the first nip region NP1 formed between the endless belt 181 and the roller 81. The first nip region NP1 has an upstream end P1 and a downstream end P2. A sheet S to be nipped and conveyed through the first nip region NP1 enters the first nip region NP1 through the upstream end P1 and exits the first nip region NP1 through the downstream end P2.

The nip-forming member 183 includes a support plate 183A and a first elastic pad 183B. The first elastic pad 183B is fixed to the support plate 183A.

The nip-forming member 182 includes a support plate 182A and a second elastic pad 182B. The second elastic pad 182B is fixed to the support plate 182A.

The first elastic pad 183B and the second elastic pad 182B are located apart from each other in the direction of conveyance of a sheet S (hereinafter referred to simply as "sheet conveyance direction"; the sheet conveyance direction refers to a direction of travel of a sheet S along the sheet conveyance path shown in FIG. 1). To be more specific, the first elastic pad 183B is located downstream of the second elastic pad 182B in the sheet conveyance direction. The second elastic pad 182B is located upstream of the first elastic pad 183B in the sheet conveyance direction. The first elastic pad 183B is located at the downstream end P2 of the first nip region NP1 to form the first nip region NP1 between the first elastic pad 183B and the elastic layer 81B. The second elastic pad 182B is located at the upstream end P1 of the first nip region NP1 to form the first nip region NP1 between the second elastic pad 182B and the elastic layer 81B.

The first elastic pad 183B has elasticity, and thus is elastically deformable. In the illustrated fixing device, the first elastic pad 183B has an elastic modulus greater than an elastic modulus of the elastic layer 81B. However, when the roller 81 and the first elastic pad 183B are pressed against each other, the elastic layer 81B deforms less than the first elastic pad 183B, because the first elastic pad 183B has a thickness greater than a thickness of the elastic layer 81B.

Specifically, the thickness of the first elastic pad 183B is eight to twelve times as great as the thickness of the elastic layer 81B. When the roller 81 and the first elastic pad 183B are pressed against each other, the deformation of the elastic layer 81B is 0.45 to 0.55 times the deformation of the first elastic pad 183B.

The second elastic pad 182B has elasticity, and thus is elastically deformable. The second elastic pad 182B has an elastic modulus smaller than the elastic modulus of the first elastic pad 183B. In the illustrated fixing device, the elastic modulus of the second elastic pad 182B is smaller than the elastic layer 81B. The second elastic pad 182B has a thickness greater than the thickness of the elastic layer 81B. When the roller 81 and the second elastic pad 182B are pressed against each other, the elastic layer 81B deforms less than the second elastic pad 182B. When the roller and each of the nip-forming members 182, 183 are pressed against each other, the deformation of the second elastic pad 182B is greater than the deformation of the first elastic pad 183B.

The support member 184 is configured to hold and support the nip-forming members 182, 183.

The upstream belt guide 185 is located upstream of the first nip region NP1 in the sheet conveyance direction to guide the movement of the endless belt 181. The upstream belt guide 185 has an outwardly curved surface contoured to allow the endless belt 181 to rotate smoothly.

The downstream belt guide 186 is located downstream of the first nip region NP1 in the sheet conveyance direction to guide the movement of the endless belt 181. The downstream belt guide 186 has an outwardly curved surface contoured to allow the endless belt 181 to rotate smoothly.

The stay 187 is configured to support the support member 184, the upstream belt guide 185, the downstream belt guide 186, and the side guides 189. The stay 187 is made by press forming of sheet metal.

The slide sheet 188 is a single sheet located between the belt 181 and each of the upstream belt guide 185, the nip-forming members 182, 183 and the downstream belt guide 186. The slide sheet 188 is made of a material having an excellent slipperiness and a surface thereof facing the endless belt 181 has projections and depressions formed to allow grease to be held thereon.

The side guides 189 are provided adjacent to both side edges of the endless belt 181. The side edges of the endless belt 181 face outward in a direction of the rotation axis 81X of the roller 81 (hereinafter referred to simply as "axial direction"). Each of the side guides 189 includes an inner guide 189A and a flange 189B. The inner guide 189A is located inside the endless belt 181, and has a shape of a segment of a circle as seen from outside in a direction parallel to the axial direction. The flange 189B extends from the outer edge of the inner guide 189A outward in directions perpendicular to the rotation axis 81X. The flange 189B serves to block the endless belt 181 from moving aside in the axial direction beyond the outer edge of the inner guide 189A.

Figure 4:
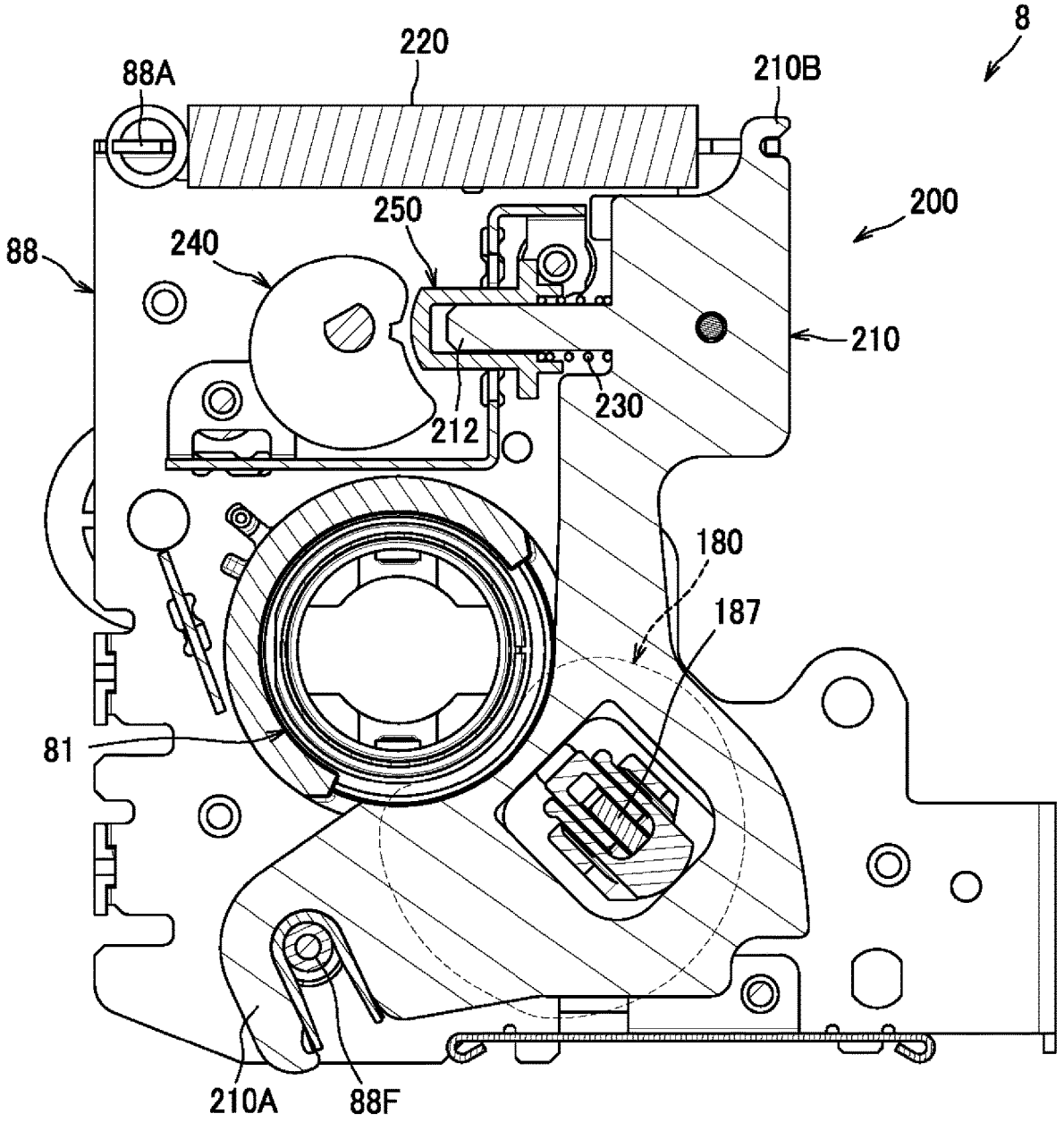
FIG. 4 is a schematic diagram for explaining a nip-pressure control mechanism.

As shown in FIG. 4, the nip-pressure control mechanism 200 includes a swing arm 210, a first spring 220, a second spring 230, a cam 240, and a cam follower 250. It is to be understood that the nip-pressure control mechanism 200 configured as shown in FIG. 4 is provided on one of two sides of the fixing frame 88 located apart from each other in the axial direction, and another similarly configured nip-pressure control mechanism 200 is provided symmetrically on the other of the two sides of the fixing frame 88 located apart from each other in the axial direction.

The swing arm 210 is located, just as with all other elements of the nip-pressure control mechanism 200, on each of the two sides of the fixing frame 88 located apart from each other in the axial direction. The swing arm 210 has one end portion 210A supported swingably on a shaft 88F provided on the fixing frame 88. On the other end portion 210B of the swing arm 210, one end of the first spring 220 is hooked. The first spring 220 is a tension spring. The other end of the first spring 220 is hooked on a spring anchor 88A, so that the swing arm 210 is always biased in a counterclockwise direction of FIG. 5 by the first spring 220. The swing arm 210 is configured to support the stay 187 of the fixing device 180 via several members, so that the fixing member 180 is supported swingably relative to the fixing frame 88.

The swing arm 210 includes a guide protrusion 212 extending long toward the cam 240. The cam follower 250 is fitted on the guide protrusion 212 in a manner that permits the cam follower 250 to slide relative to the guide protrusion 212. The second spring 230 is provided between the cam follower 250 and a portion of the swing arm 210 around a base end of the guide protrusion 212 (i.e., distal end from which the guide protrusion 212 protrudes). The second spring 230 is a compression spring.

The cam 240 is located opposite the cam follower 250, and is caused to rotate by a motor (not shown). As the cam 240 rotates, the cam follower 250 is pushed and imparts a swinging motion to the swing arm 210, which in turn causes the fixing member 180 to move relative to the roller 81, so that the nip pressure between the roller 81 and the fixing member 180 is adjusted. To be more specific, the nip pressure can be adjusted according to the rotation of the cam 240 to a highest nip pressure under which strong nip conditions fit for fixing on a standard-thickness sheet of ordinary (basis-weight) paper are achieved, to a lower nip pressure (i.e., lower than the highest nip pressure) under which weak nip conditions fit for fixing on a sheet thicker than the standard-thickness sheet are achieved, and to a weakest nip pressure under which nip release conditions fit for removing a sheet S jammed in the fixing device 8 are achieved.

Figure 5:
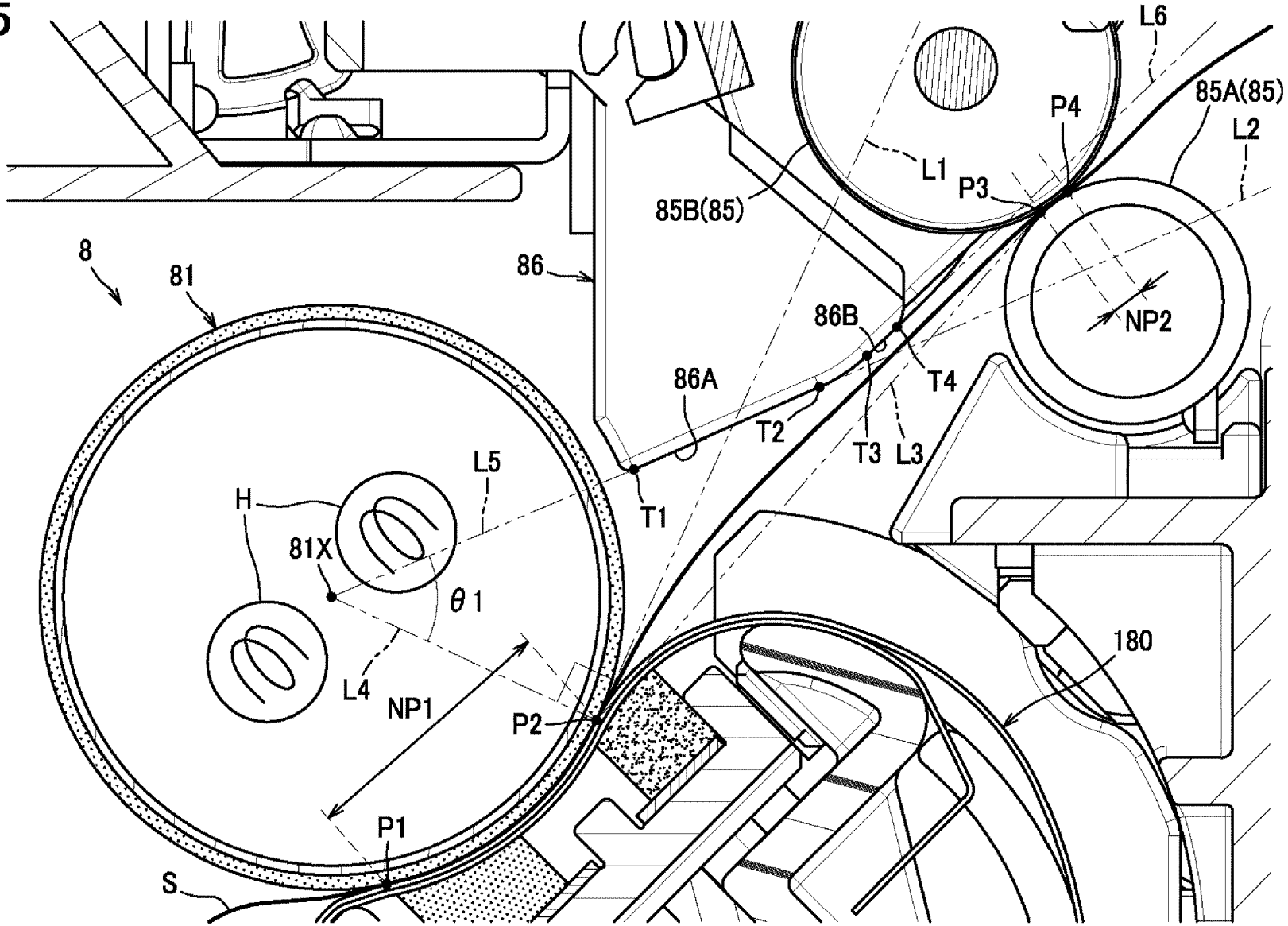
FIG. 5 is a partially enlarged section view of the fixing device, showing nip regions and their vicinities.

As shown in FIG. 5, the pair of conveyor rollers 85 are located downstream of the first nip region NP1 in the sheet conveyance direction. The pair of conveyor rollers 85 are rollers configured to convey a sheet S subjected to a thermal fixing process in the first nip region NP1, toward the conveyor unit 9 (specifically, toward the second flapper FL2). There are a plurality of pairs of conveyor rollers 85 arranged in a line parallel to the axial direction. Each pair of conveyor rollers 85 includes a first roller 85A and a second roller 85B opposed to the first roller 85A. The first roller 85A and the second roller 85B form a second nip region NP2 therebetween. The second nip region NP2 has an upstream end P3 and a downstream end P4. The upstream end P3 of the second nip region NP2 is an entrance at which a sheet S coming out of the first nip region NP1 enters the second nip region NP2. The downstream end P4 of the second nip region NP2 is an exit at which the sheet S conveyed through the second nip region NP2 goes out of the second nip region NP2.

The pair of conveyor rollers 85 nip and convey a sheet S in the second nip region NP2. The speed of conveyance of the sheet S by (the sheet conveyance speed of) the pair of conveyor rollers 85 is higher than the sheet conveyance speed of the roller 81.

The first roller 85A includes an outer peripheral portion having an outer cylindrical surface. The outer peripheral portion of the first roller 85A is made of rubber. The first roller 85A receives a driving force from the motor M (see FIG. 2) and is thereby caused to rotate. The second roller 85B includes an outer peripheral portion having an outer cylindrical surface. The outer peripheral portion is made of plastic. The outer cylindrical surface of the second roller 85B is pressed against the outer cylindrical surface of the first roller 85A, so that the second roller 85B follows the rotation of the first roller, and is thus caused to rotate according as the first roller rotates. A friction force between the second nip region NP2 and a sheet S is smaller than a friction force between the first nip region NP1 and the sheet S. The force of conveyance of the sheet S (conveyance force) produced in the second nip region NP2 is smaller than the conveyance force produced in in the first nip region NP1.

The sheet guide 86 is located between the roller 81 and the pair of conveyor rollers 85 (i.e., to guide a sheet between the first nip region NP1 and the second nip region NP2). The sheet guide 86 is configured to guide a roller 81-side surface of a sheet S, and is kept out of contact with the roller 81. In the present embodiment, the sheet guide 86 is located above (along an upper side of) a sheet S being conveyed toward the second nip region NP2. In other words, when a sheet S is conveyed from the first nip region NP1 to the second nip region NP2, the sheet guide 86 is contactable with the upper side of the sheet S.

To be more specific, the seat guide 86 is made up of ribs (not shown) extending in the sheet conveyance direction and arranged at intervals in the axial direction. The seat guide 86 includes a first guide 86A and a second guide 86B. The first guide 86A and the second guide 86B are formed at each of edges of the ribs. In other words, the first guide 86A and the second guide 86B are configured as edges of ribs along which to guide the roller 81-side surface of the sheet S.

The first guide 86A is a guide closest to the roller 81, and guides a sheet S conveyed out from the first nip region NP1. The first guide 86A has an upstream end T1 and a downstream end T2 located upstream and downstream respectively in the sheet conveyance direction. The first guide 86A extends straight from the upstream end T1 to the downstream end T2. In a plane perpendicular to the rotation axis 81X of the roller 81, the first guide 86A has a linear shape and intersects with a line L1 tangent to the outer cylindrical surface of the roller 81 at the downstream end P2 of the first nip region NP1.

In the plane perpendicular to the rotation axis 81X of the roller 81, an extension line L2 of the first guide 86A intersects with a line segment L3 connecting the downstream end P2 of the first nip region NP1 to the upstream end P3 of the second nip region NP2. The extension line L2 is a straight line extended from the downstream end T2 downstream in the direction of extension of the first guide 86A.

In the plane perpendicular to the rotation axis 81X of the roller 81, an angle θ1 formed between a straight line L4 connecting the rotation axis 81X of the roller 81 to the downstream end P2 of the first nip region NP1 and a straight line L5 connecting the rotation axis 81X of the roller 81 to the upstream end T1 of the first guide 86A is greater than 45 degrees.

The second guide 86B is located downstream of the first guide 86A in the sheet conveyance direction. In other words, the second guide 86B is located farther, than the first guide 86A, apart from first nip region NP1. A sheet S guided along the first guide 86A in a first direction is further guided by the second guide 86B in a second direction different from the first direction.

The second guide 86B has an upstream end T3 and a downstream end T4 located upstream and downstream respectively in the sheet conveyance direction. The second guide 86B extends straight in the plane perpendicular to the rotation axis 81X. The second guide 86B has a linear shape in the plane perpendicular to the rotation axis 81X of the roller 81. The sheet guide 86 further includes a circular segment provided between the straight-line segments thereof, i.e., the first guide 86A and the second guide 86B. The circular segment is, similar to the first guide 86A and the second guide 86B, formed at each of edges of the ribs making up the seat guide 86. The circular segment connects the downstream end T2 of the first guide 86A and the upstream end T3 of the second guide 86B, and forms a rounded corner between the first guide 86A and the second guide 86B.

The second guide 86B extends more nearly parallel, than the first guide 86A does, to the line segment L3. That is, an angle formed by an extension line L6 of the second guide 86B (straight line extended in the direction of extension of the second guide 86B from a downstream end of the second guide 86B downstream in the sheet conveyance direction) with the line segment L3 is less than an angle formed by the extension line L2 of the first guide 86A with the line segment L3. To be more specific, in the plane perpendicular to the rotation axis 81X of the roller 81, the extension line L6 of the second guide 86B does not intersect with the line segment L3 connecting the downstream end P2 of the first nip region NP1 to the upstream end P3 of the second nip region NP2.

Operations and advantageous effects of the fixing device 8 configured as described above will be described in detail below.

A sheet S on which a toner image has been transferred is conveyed to the fixing device 8, and is subjected to the thermal fixing process in the first nip region NP1. In the present embodiment, because a separator that contacts the roller 81 to separate a sheet S is not provided, the sheet S conveyed out from the downstream end P2 of the first nip region NP1 tends to temporarily adhere to the roller 81 and curl to some extent for a while. Thereafter, the leading edge of the sheet S comes off the roller 81 before reaching the first guide 86A, and thus comes in contact with the first guide 86A. The sheet S is then guided by the first guide 86A and conveyed toward the second nip region NP2. Since the extension line L2 of the first guide 86A intersects with the line segment L3 connecting the downstream end P2 of the first nip region NP1 to the upstream end P3 of the second nip region NP2, the sheet S so warped as to curve toward the fixing member 180 is guided by the first guide 86A and conveyed toward the second nip region NP2. Accordingly, the sheet S conveyed out of the first nip region NP1 can be corrected out of curl.

The sheet guide 86 further includes the second guide 86B, and in the plane perpendicular to the rotation axis 81X of the roller 81, the extension line L6 of the second guide 86B does not intersect with the line segment L3 connecting the downstream end P2 of the first nip region NP1 to the upstream end P3 of the second nip region NP2; therefore, the sheet S having passed along the first guide 86A can be stably guided toward the second nip region NP2 by the second guide 86B.

In the plane perpendicular to the rotation axis 81X of the roller 81, an angle θ1 formed between the straight line L4 connecting the rotation axis 81X of the roller 81 to the downstream end P2 of the first nip region NP1 and the straight line L5 connecting the rotation axis 81X of the roller 81 to the upstream end T1 of the first guide 86A is greater than 45 degrees; therefore, the distance between the first guide 86A and the downstream end P2 of the first nip region NP1 is made longer, and the leading edge of the sheet S is made likely to separate from the roller 81 before contacting the first guide 86A. Accordingly, separation of the sheet S from the roller 81 is facilitated.

The sheet conveyance speed of the pair of conveyor rollers 85 is higher than the sheet conveyance speed of the roller 81; therefore, unfavorable sagging of the sheet S between the first nip region NP1 and the second nip region NP2 can be restrained, and a proper tension kept on the sheet S can serve to make the sheet S out of curl.

The conveyance force produced in the second nip region NP2 is smaller than the conveyance force produced in the first nip region NP1; therefore, the sheet S nipped in both of the first nip region NP1 and the second nip region NP2 can be restrained from being excessively pulled by the second nip region NP2 with a force greater than necessary.

Although one illustrative, non-limiting embodiment has been described above, the above-described fixing device may be modified and implemented in various forms as will be described below.

Figure 6A:
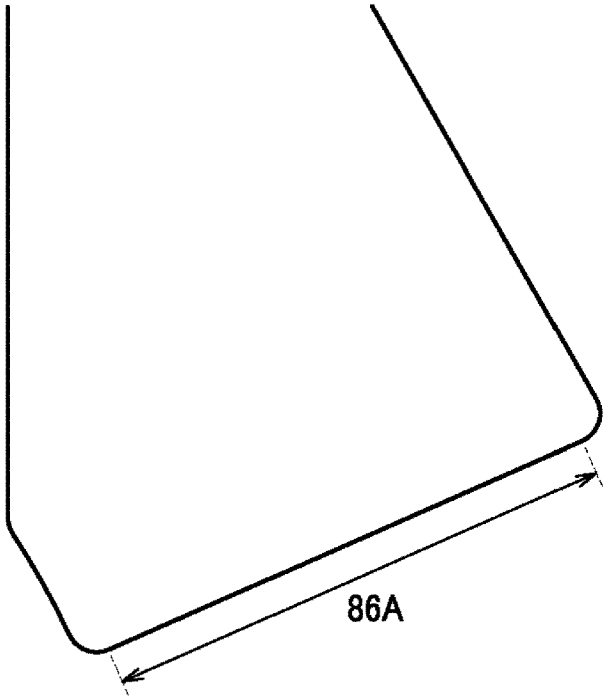
FIGS. 6A and 6B show alternative examples of a sheet guide.
Figure 6B:
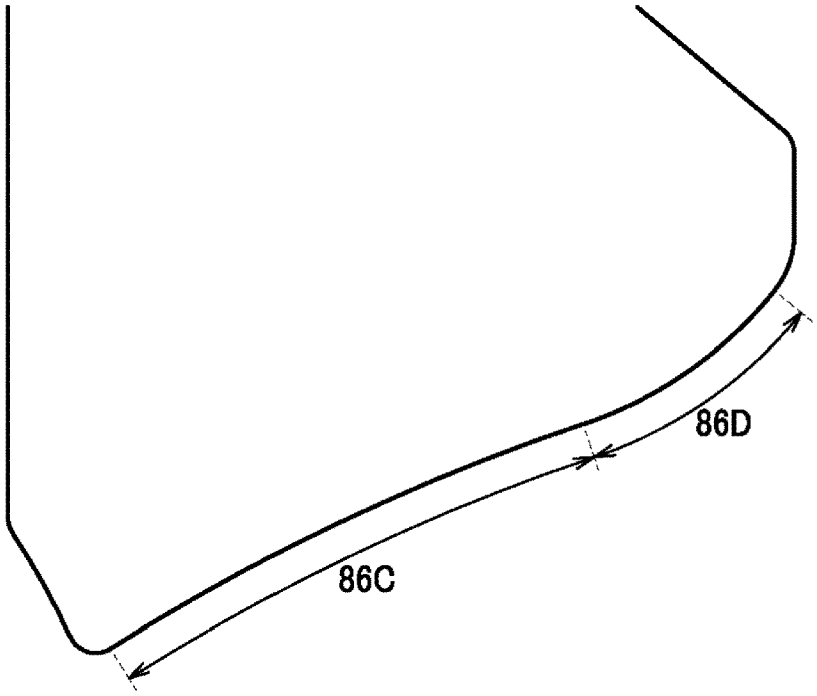

In the above-described embodiment, the seat guide 86 includes the first guide 86A and the second guide 86B; however, the seat guide may include only a first guide 86A as illustrated in FIG. 6A. The first guide 86A and/or the second guide 86B may not be configured as a straight line in the plane perpendicular to the rotation axis 81X. The first guide and the second guide may extend in curves; for example, as illustrated in FIG. 6B, a first guide 86C extends in a concave curve with its center recessed away from the sheet conveyance path, while a second guide 86D extends in a convex curve with its center bulged into the sheet conveyance path.

In the above-described embodiment, the heater H is configured to heat the roller 81, but the heater H may be configured to heat the belt 181 of the fixing member 180.

In the above-described embodiment, the nip-forming members 182, 183 of the fixing member 180 are each configured to include an elastic pad 182B, 183B fixed to a support plate 182A, 183A, but may be configured to include a roller. Moreover, a nip-forming member configured as a single elastic pad may be adopted.

In the above-described embodiment, two heaters H are provided. However, the number of heaters may be one or more than three.

In the above-described embodiment, the heaters H are located inside the roller 81, but the heater(s) may be located outside the roller.

The elements described in the above embodiment and its modified examples may be implemented selectively and in combination.

What is claimed is:

1. A fixing device comprising:

a roller;

an endless belt;

a nip-forming member configured to form a first nip region between the endless belt and the roller;

a heater;

a pair of conveyor rollers located downstream of the first nip region in a sheet conveyance direction and configured to convey a sheet through a second nip region formed therebetween; and a sheet guide located between the roller and the pair of conveyor rollers, the sheet guide comprising a first guide along which to guide a roller-side surface of the sheet, wherein the first guide intersects with a line tangent to an outer cylindrical surface of the roller at a downstream end of the first nip region, wherein an extension line of the first guide intersects with a line segment connecting the downstream end of the first nip region to an upstream end of the second nip region, wherein the sheet guide further comprises a second guide located between the first guide and the pair of conveyor rollers, the second guide being connected to the first guide to guide the roller-side surface of the sheet, and wherein an extension line of the second guide does not intersect with the line segment.

2. The fixing device according to claim 1, wherein the first guide has a linear shape.

3. The fixing device according to claim 1, wherein the second guide has a linear shape.

4. The fixing device according to claim 1, wherein an angle formed between a straight line connecting the rotation axis to the downstream end of the first nip region and a straight line connecting the rotation axis to an upstream end of the first guide is greater than 45 degrees.

5. The fixing device according to claim 1, wherein the roller and the pair of conveyor rollers are driven by a motor, wherein a sheet conveyance speed of the pair of conveyor rollers is higher than a sheet conveyance speed of the roller.

6. The fixing device according to claim 1, wherein a conveyance force produced in the second nip region is smaller than a conveyance force produced in the first nip region.

7. The fixing device according to claim 1, wherein the nip forming member includes a first elastic pad located at the downstream end of the first nip region to form the first nip region between the first elastic pad and the roller.

8. The fixing device according to claim 7, wherein the roller includes an elastic layer by which the outer cylindrical surface of the roller is provided, wherein the first elastic pad has an elastic modulus greater than an elastic modulus of the elastic layer, and wherein when the roller and the first elastic pad are pressed against each other, the elastic layer deforms less than the first elastic pad.

9. The fixing device according to claim 1, wherein the heater is located inside the roller.

10. A fixing device, comprising:

a roller;

an endless belt;

a nip-forming member configured to form a first nip region between the endless belt and the roller;

a heater;

a pair of conveyor rollers located downstream of the first nip region in a sheet conveyance direction and configured to convey a sheet through a second nip region formed therebetween; and a sheet guide located between the roller and the pair of conveyor rollers, the sheet guide comprising a first guide along which to guide a roller-side surface of the sheet, wherein the first guide intersects with a line tangent to an outer cylindrical surface of the roller at a downstream end of the first nip region, wherein an extension line of the first guide intersects with a line segment connecting the downstream end of the first nip region to an upstream end of the second nip region, wherein the nip forming member includes a first elastic pad located at the downstream end of the first nip region to form the first nip region between the first elastic pad and the roller, wherein the roller includes an elastic layer by which the outer cylindrical surface of the roller is provided, wherein the first elastic pad has an elastic modulus greater than an elastic modulus of the elastic layer, wherein when the roller and the first elastic pad are pressed against each other, the elastic layer deforms less than the first elastic pad, and wherein the nip-forming member further includes a second elastic pad located upstream of the first elastic pad in the sheet conveyance direction to form the first nip region between the second elastic pad and the elastic layer, the second elastic pad having an elastic modulus smaller than the elastic modulus of the elastic layer.

11. The fixing device according to claim 10, wherein the first elastic pad and the second elastic pad are located apart from each other in the sheet conveyance direction.

12. The fixing device according to claim 10, wherein the first guide has a linear shape.

13. The fixing device according to claim 10, wherein the roller and the pair of conveyor rollers are driven by a motor, wherein a sheet conveyance speed of the pair of conveyor rollers is higher than a sheet conveyance speed of the roller.

14. The fixing device according to claim 10, wherein a conveyance force produced in the second nip region is smaller than a conveyance force produced in the first nip region.

15. The fixing device according to claim 10, wherein the heater is located inside the roller.

16. A fixing device, comprising:

a roller;

an endless belt;

a nip-forming member configured to form a first nip region between the endless belt and the roller;

a heater;

a pair of conveyor rollers located downstream of the first nip region in a sheet conveyance direction and configured to convey a sheet through a second nip region formed therebetween; and a sheet guide located between the roller and the pair of conveyor rollers, the sheet guide comprising a first guide along which to guide a roller-side surface of the sheet, wherein the first guide intersects with a line tangent to an outer cylindrical surface of the roller at a downstream end of the first nip region, wherein an extension line of the first guide intersects with a line segment connecting the downstream end of the first nip region to an upstream end of the second nip region, wherein an angle formed between a straight line connecting the rotation axis to the downstream end of the first nip region and a straight line connecting the rotation axis to an upstream end of the first guide is greater than 45 degrees.

17. The fixing device according to claim 16, wherein the first guide has a linear shape.

18. The fixing device according to claim 16, wherein the roller and the pair of conveyor rollers are driven by a motor, wherein a sheet conveyance speed of the pair of conveyor rollers is higher than a sheet conveyance speed of the roller.

19. The fixing device according to claim 16, wherein a conveyance force produced in the second nip region is smaller than a conveyance force produced in the first nip region.

20. The fixing device according to claim 16, wherein the heater is located inside the roller.

* * * * *